US006746135B2

(12) United States Patent
Tsang

(10) Patent No.: US 6,746,135 B2
(45) Date of Patent: Jun. 8, 2004

(54) ILLUMINATED SOAP BAR WITH SOUND

(75) Inventor: Henry H. T. Tsang, Richmond Hill (CA)

(73) Assignee: Henry Tsang, Richmond Hill (CA)

( * ) Notice: Subject to any disclaimer, the term of this patent is extended or adjusted under 35 U.S.C. 154(b) by 0 days.

(21) Appl. No.: 10/243,762

(22) Filed: Sep. 16, 2002

(65) Prior Publication Data

US 2003/0227775 A1 Dec. 11, 2003

(51) Int. Cl.[7] ..... F21V 33/00

(52) U.S. Cl. ..... 362/253; 362/276; 362/101; 362/158; 446/81

(58) Field of Search ..... 362/253, 101, 362/157, 158, 276, 802, 800, 311; 446/81; 510/100

(56) References Cited

U.S. PATENT DOCUMENTS 4,861,505 A * 8/1989 Farman ..... 510/100
5,211,469 A 5/1993 Matthias et al.
5,482,078 A 1/1996 Yeh
5,545,069 A 8/1996 Glynn et al.
5,971,827 A * 10/1999 Lee et al. ..... 446/81
6,020,823 A 2/2000 DeCicco
6,052,338 A 4/2000 Shevins
6,116,753 A * 9/2000 Tsang ..... 362/253
6,163,258 A 12/2000 Rudell et al.

* cited by examiner

*Primary Examiner*—Sandra O'Shaa
*Assistant Examiner*—Ali Alavi
(74) *Attorney, Agent, or Firm*—Ingrid E. Schmidt

(57) ABSTRACT

A donut shaped soap body has a special effect cartridge which emits sound and light triggered by movement of the soap bar or by wetting of the soap bar. The special effect cartridge has a sealed chamber and light support for back-lighting an image and an open acoustic chamber for housing a miniature loudspeaker.

31 Claims, 5 Drawing Sheets

ILLUMINATED SOAP BAR WITH SOUND

FIELD OF THE INVENTION

This invention relates to a novelty soap bar and to a special effect cartridge for use in a novelty item of merchandise.

BACKGROUND OF THE INVENTION

Novelty soap bars exist in various shapes, colours and fragrances for the pleasure of the owner and end user. One soap bar described in U.S. Pat. No. 6,116,753 provides a light source which is activated whenever the soap bar is wet.

An object of this invention is to provide a soap bar which provides still more entertainment than an illuminated soap bar.

SUMMARY OF THE INVENTION

In accordance with one aspect of this invention, there is provided a soap bar having a special effect cartridge for producing light effects through an image.

The special effect cartridge has a sealed chamber through which light is transmitted and which houses an electronic circuit and a power source. A light source provided in the sealed chamber is optionally mounted to a support spaced from a translucent portion of a housing where an image is mounted. In this way, the image is backlit whenever the light source is actuated.

Actuation may take place by movement or by wetting the soap bar in a conductive medium. The soap bar has at least one movement actuated switch or a wet switch in the form of a pair of electric probes.

In accordance with another aspect of the invention, the soap bar has a loudspeaker in a discrete housing which defines an open acoustic chamber through which sound is transmitted.

BRIEF DESCRIPTION OF THE DRAWINGS

In order that the invention may be more clearly understood, a preferred embodiment of the invention is described with reference to the accompanying drawings, in which.

DESCRIPTION OF PREFERRED EMBODIMENT

Figure 1:
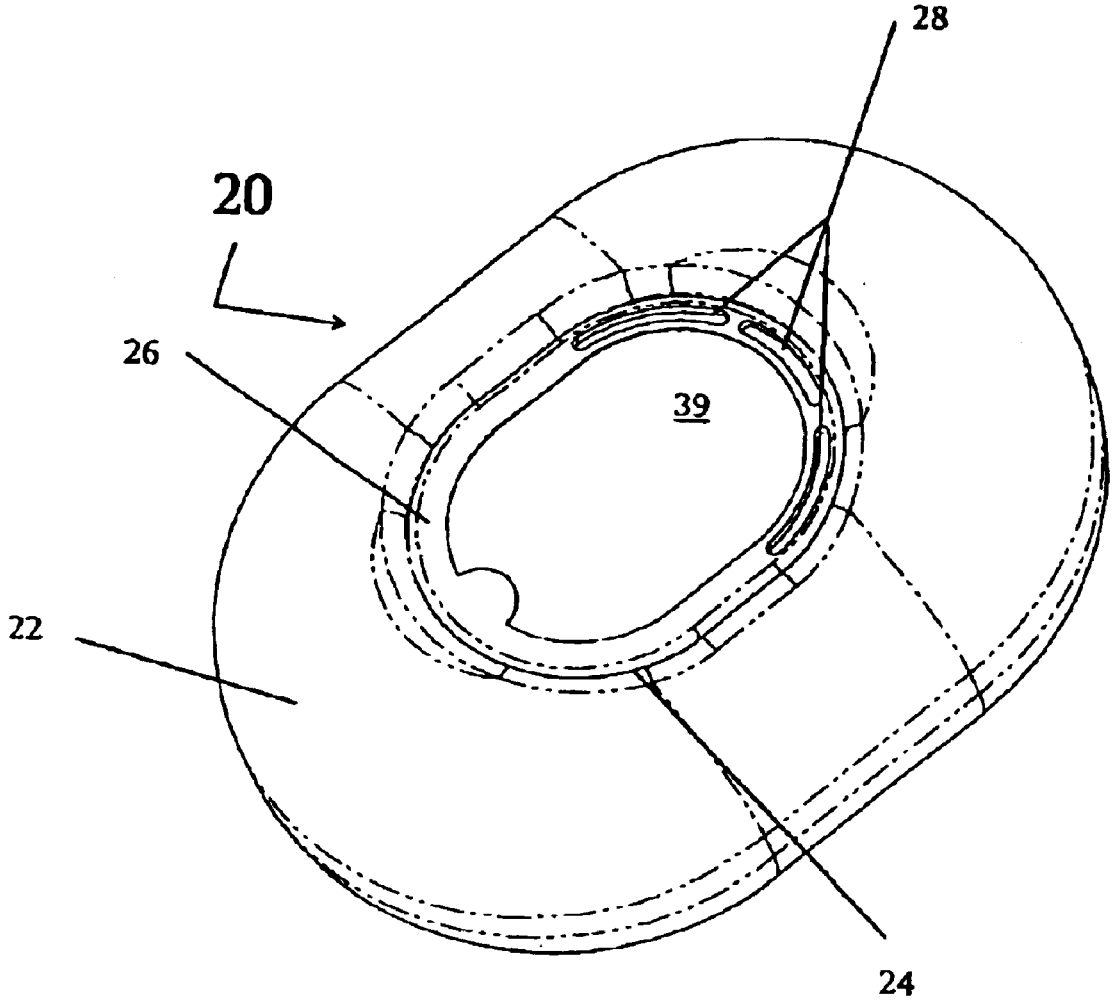
FIG. 1 is a perspective view from the top of a soap bar made in accordance with the invention.

A soap bar in accordance with the invention is generally indicated in the drawings by reference numeral 20. The soap bar 20 has a soap body 22 which is somewhat oblong with a rounded exterior surface and a central cavity 24 which extends through the soap body 22 through opposite upper and lower surfaces of the soap body. The soap body 22 effectively has the shape of a toroid or donut.

A special effect cartridge 26 is disposed in the cavity 24. In FIG. 1, it will be seen that the top surface 39 of the special effect cartridge 26 has a series of three arcuate openings 28 disposed on one side of the special effect cartridge.

Figure 2:
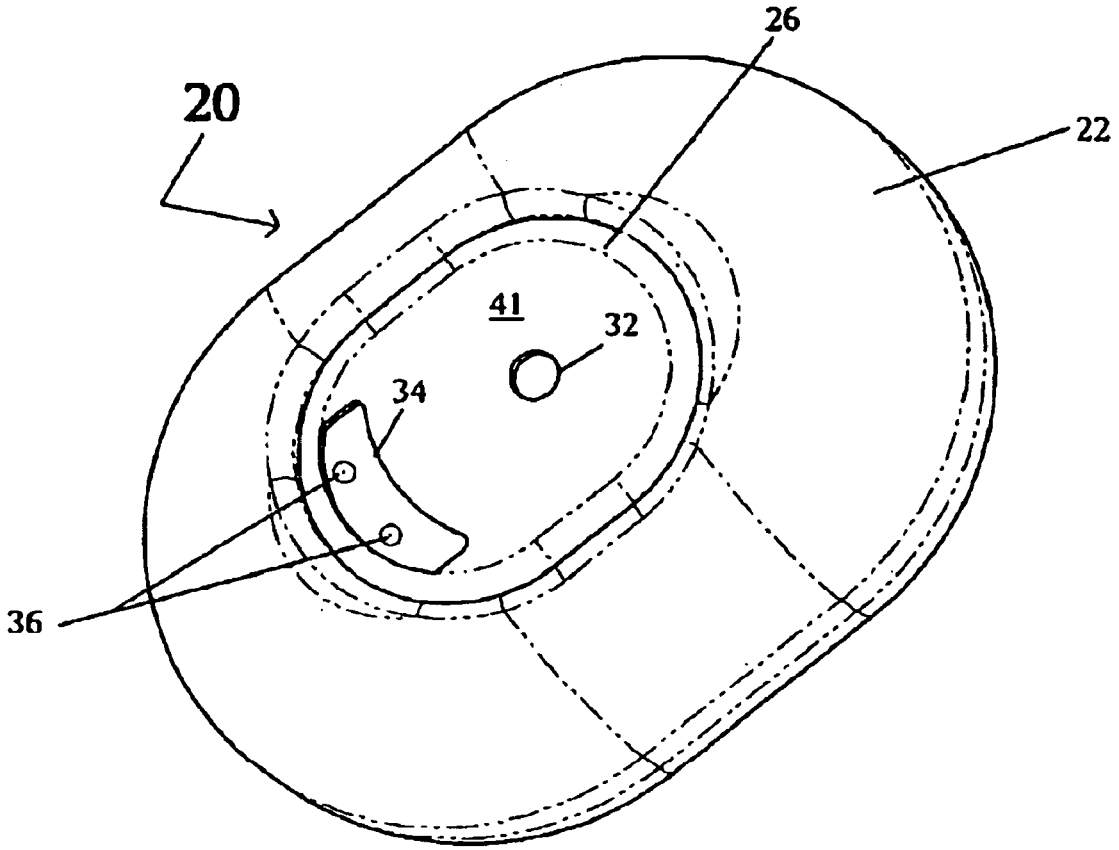
FIG. 2 is a perspective view from the bottom of the soap bar of FIG. 1.

In the bottom view of the soap bar 20 shown in FIG. 2, it will be seen that the special effect cartridge 26 has a single drain hole 32 formed in a bottom surface 41 thereof and an access slot 34 exposing a pair of spaced apart electric probes 36 which will be described in more detail below.

Figure 3:
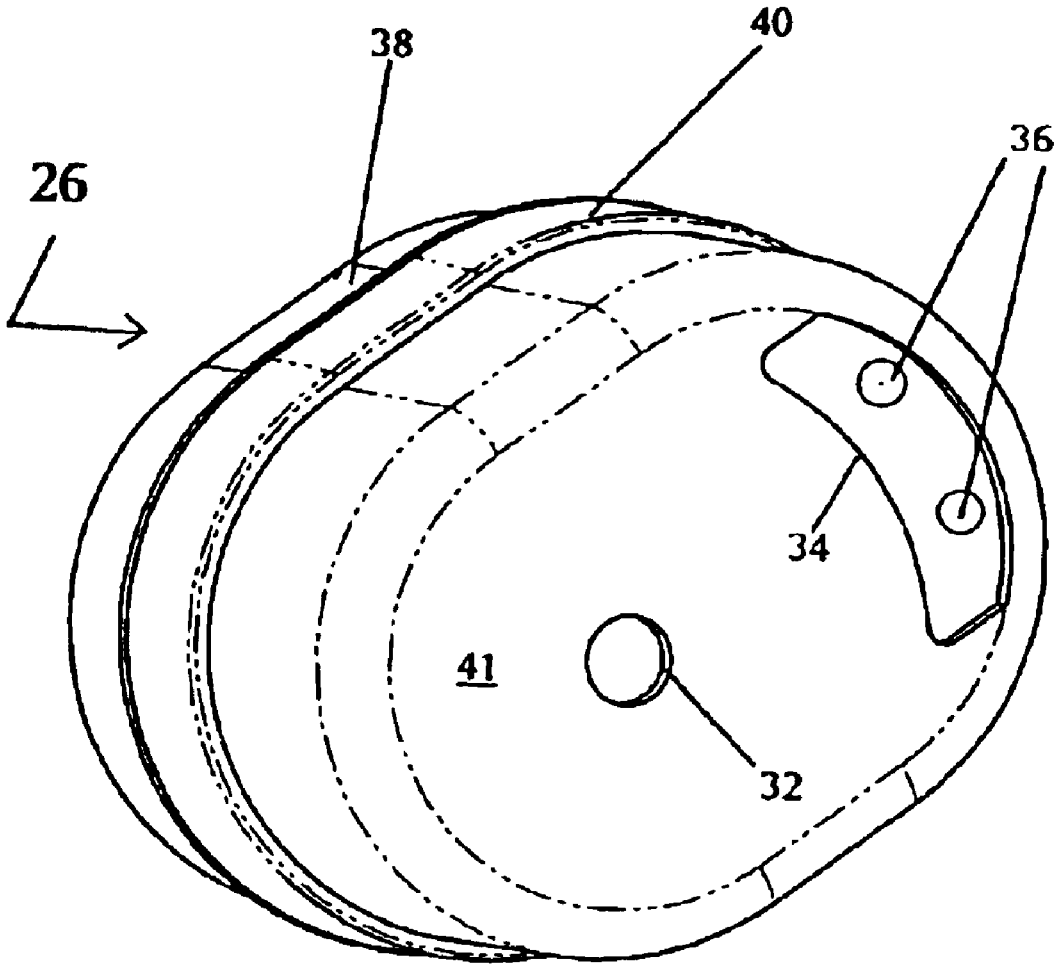
FIG. 3 is a perspective view from the bottom of a special effect cartridge (drawn to a larger scale) for use in the soap bar of FIG. 1.
Figure 4:
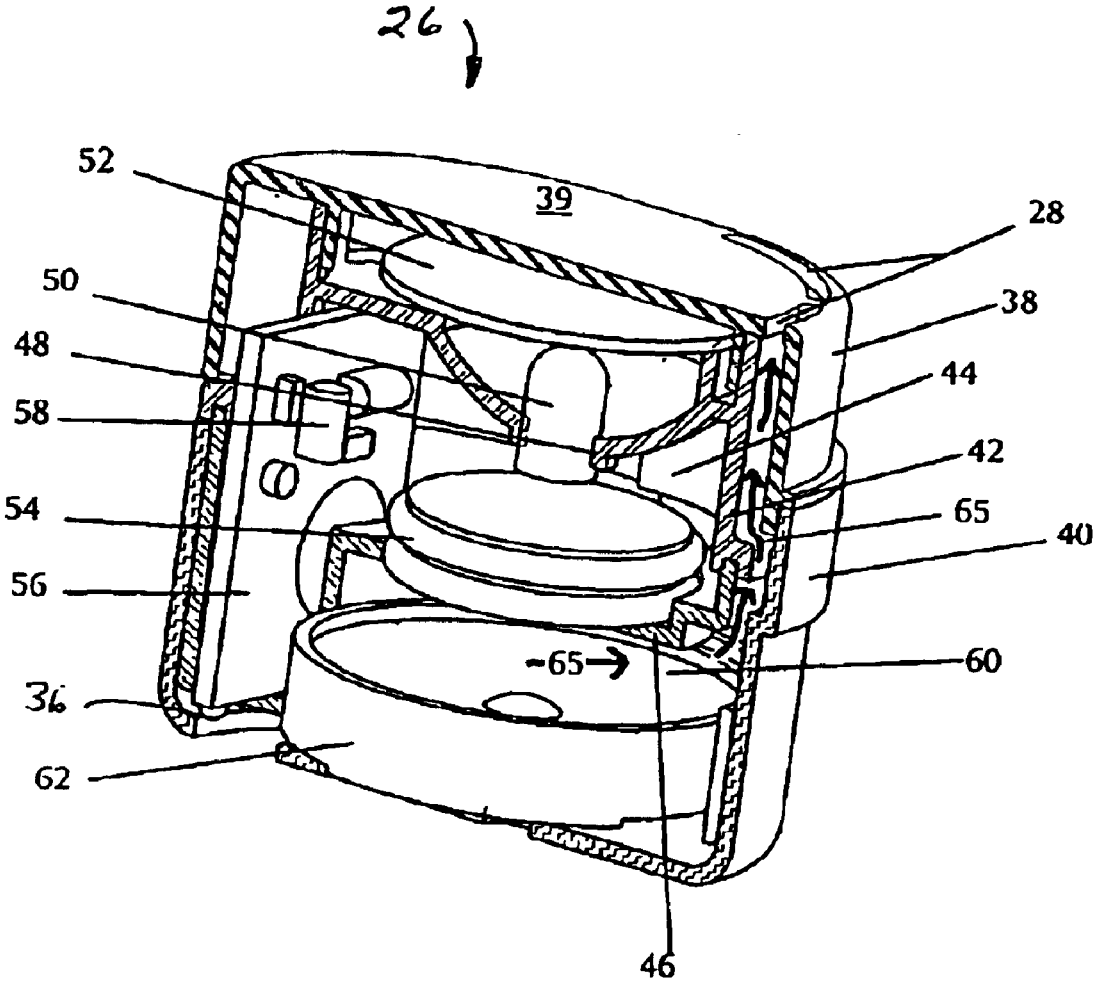
FIG. 4 is a partially sectioned perspective view from the top of the special effect cartridge of FIG. 3.
Figure 5:
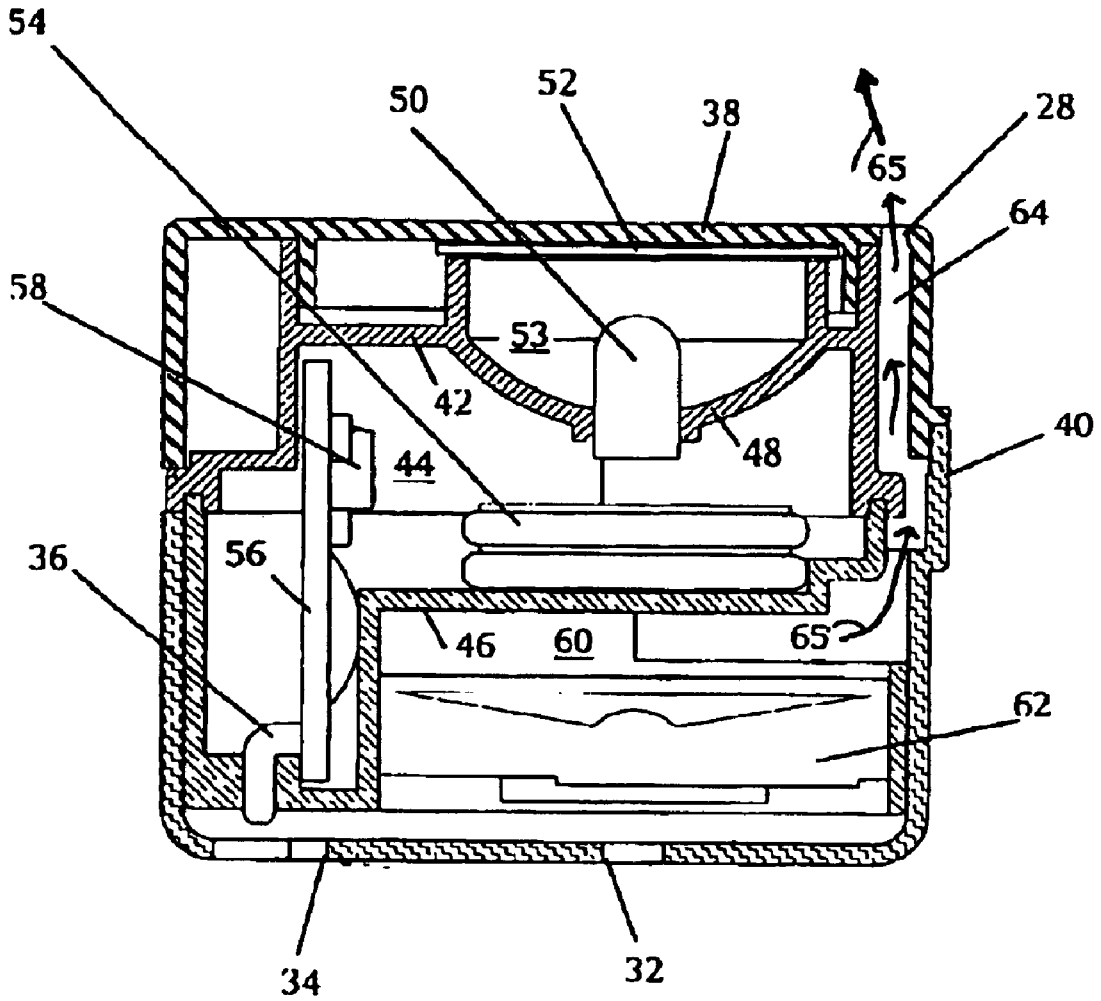
FIG. 5 is a partially sectioned elevational view of the special effect cartridge of FIG. 3.

Now turning to FIG. 3, it will be seen that the special effect cartridge 26 has an upper casing 38 which is coupled to a lower casing 40 and which together encapsulate the components of the special effect cartridge. The upper casing 38 defines the top surface 39 for the special effect cartridge 26 which is translucent in order to allow light to be transmitted through the cartridge and has dependent side walls which engage corresponding side walls of the lower casing 40. The lower casing 40 defines the bottom surface 41 of the special effect cartridge 26 and is made of an opaque material.

A ridge is formed in the lower casing 40 at the junction with the upper casing 38. The ridge serves to hold the special effect cartridge inside the soap body 22 which is formed around the pre-assembled cartridge 26 during fabrication of the soap.

A first housing 42 defines a sealed chamber 44 within the special effect cartridge 26. The first housing 42 is defined by upright portions which sealingly engage the top translucent portion of the upper casing 38 at one end and a dividing wall at the other end which also forms part of a second housing 46. The first housing 42 has a substructure consisting of a light support 48 which sealingly engages a light source in the form of a miniature bulb 50 or led so that it is downwardly spaced from the translucent top surface 39 of the upper casing 38. An image slide in the form of a disc 52 is mounted beneath the top translucent surface 39 of the upper casing 38 and is spaced from the light bulb 50 so that the image of the disc 52 will be back lit. Conveniently, the light support 48 may have a metalized surface 53 opposite to the translucent portion in order to reflect light and enhance the image.

A pair of batteries 54 is supported inside the sealed chamber 44 and electrically coupled to the light bulb 50 and to a printed circuit board assembly which is generally indicated by reference numeral 56. The printed circuit board assembly 56 forms part of an electronic circuit which includes a programmable integrated circuit for performing a predetermined sequence of light and sound effects when actuated by a switch.

In the embodiment illustrated, there are two switches, namely a movement actuated electrical switch 58 mounted to the printed circuit board assembly 56 and received inside the sealed chamber 44 and also a wet switch comprising the spaced apart electric probes 36 which are external to the first housing 42 and which are electrically coupled to the electronic circuit, the electric probes being actuated by contact with a conductive medium such as water for energizing the light bulb 50. Water is brought into contact with the electric probes 36 through the access slot 34. Thus both movement of the soap 20 and wetting of the soap 20 will cause the light bulb 50 to shine through the disc 52 and illuminate the top surface 39 of the soap.

The second housing 46 which includes portions of the upper and lower casing 38, 40 defines an open acoustic chamber 60 which receives a miniature loudspeaker 62 which is electrically coupled to the printed circuit board assembly 56. As will be seen in the drawings, the loudspeaker 62 is confined between the dividing wall which forms part of the second housing 46 and which subdivides the sealed chamber 44 from the open acoustic chamber 60, and the bottom wall of the lower casing 40. A narrow annular passage 64 is formed between the outer wall of the first housing 42 and the inner surface of the upper and lower casing 38, 40. This annular passage terminates in the arcuate openings 28 formed in the upper surface of the upper casing 38 and through which sound may be transmitted as indicated by arrows 65. The drain hole 32 formed in the bottom surface of the lower casing 40 is disposed opposite to the loudspeaker 62 and will allow any conductive medium such as water to drain through the special effect cartridge 36 so that it will not collect in the acoustic chamber 60.

In use therefore, the special effect cartridge may be actuated by movement of the soap bar 20 or by wetting of the electric probes 36 to cause both light and sound to be transmitted from the cartridge. The sequence of light and sound which will be produced is programmed by the integrated circuit formed in the printed circuit board assembly 56. The soap bar may therefore emit a particular sequence of sound and light when the soap bar is picked up and moved by a user and another sequence of sound and light when the soap bar is wetted or immersed in a conductive medium.

It will be appreciated that several variations may be made to the above described embodiment of the invention as will readily be apparent to those skilled in the art. It will therefore be appreciated that the special effect cartridge could produce light or sound or both light and sound and is not limited to producing the two together. Also, the triggering of any special effects may be done by either movement or wetting of the soap bar or both movement and wetting of the soap bar. It will also be understood that the image disc 52 and the light support 48 for spacing the light bulb from the image disc are optional and that they may be substituted by other imaging modules.

As will readily be apparent, the special effect cartridge may be incorporated, and modified as necessary, for use in a body other than a soap bar. The special effect cartridge could readily be transformed for use in a novelty item of merchandise.

What is claimed is:

1. A soap bar having a soap body defining a cavity and a special effect cartridge received in said cavity, the special effect cartridge having a first housing defining a sealed chamber having a translucent portion for transmitting light;

a second housing coupled to the first housing and defining an open acoustic chamber having at least one opening for transmitting sound;

an electronic circuit received in said sealed chamber including a power source operatively coupled to at least one light source and at least one movement actuated electrical switch received in said sealed chamber for energizing said light source and a loudspeaker; and a loudspeaker disposed in said second housing for emitting sound through said open acoustic chamber, wherein movement of the soap bar will trigger sound and light to be transmitted from the special effect cartridge.

2. A soap bar according to claim 1 in which the first housing has a light support sealingly engaging said at least one light source and spacing said at least one light source from said translucent portion of the first housing.

3. A soap bar according to claim 2 in which the light support has a light reflective surface opposite to said translucent portion of the first housing.

4. A soap bar according to claim 1 having a translucent image disposed adjacent to said translucent portion of the first housing within said sealed chamber for light to be transmitted from said at least one the light source through the image.

5. A soap bar according to claim 1 in which the electronic circuit includes a programmable integrated circuit for performing a predetermined sequence of light and sound effects.

6. A soap bar according to claim 1 in which the first housing has an external switch electrically coupled to said electronic circuit, the external switch being actuated by contact with a conductive medium for energizing said at least one light source and said loudspeaker.

7. A soap bar according to claim 1 in which the external switch comprises a pair of spaced-apart electric probes.

8. A soap bar according to claim 6 in which the second housing has an inlet opening disposed adjacent to said external switch for allowing a conductive medium to come into contact with said external switch.

9. A special effect cartridge having a first housing defining a sealed chamber;

a second housing coupled to the first housing and defining an open acoustic chamber, the second housing having a plurality of openings for transmitting sound, at least one opening being formed in a surface on one side of the special effect cartridge and at least one opening being formed in an opposite surface;

an electronic circuit received in said sealed chamber including a power source operatively coupled to at least one movement actuated electrical switch received in said sealed chamber for energizing a loudspeaker; and a loudspeaker disposed in said second housing for emitting sound through said open acoustic chamber, wherein movement of the soap bar will trigger sound to be transmitted from the special effect cartridge.

10. A soap bar according to claim 1 in which the soap body has a cavity which extends through opposite surfaces of the soap body.

11. A soap bar having a soap body defining a cavity and a special effect cartridge received in said cavity, the special effect cartridge having a first housing defining a sealed chamber;

a second housing coupled to the first housing and defining an open acoustic chamber having at least one opening for transmitting sound;

an electronic circuit received in said sealed chamber including a power source operatively coupled to at least one movement actuated electrical switch received in said sealed chamber for energizing a loudspeaker; and a loudspeaker disposed in said second housing for emitting sound through said open acoustic chamber, wherein movement of the soap bar will trigger sound to be transmitted from the special effect cartridge.

12. A soap bar according to claim 11 in which the electronic circuit includes a programmable integrated circuit for performing a predetermined sequence of sound effects.

13. A soap bar according to claim 11 which the first housing has an external switch electrically coupled to said electronic circuit, the external switch being actuated by contact with a conductive medium for energizing said loudspeaker.

14. A soap bar according to claim 11 in which the external switch comprises a pair of spaced-apart electric probes.

15. A soap bar according to claim 13 in which the second housing has an inlet opening disposed adjacent to said external switch for allowing a conductive medium to come into contact with said external switch.

16. A soap bar according to claim 11 in which the soap body has a cavity which extends through opposite surfaces of the soap body.

17. A soap bar according to claim 11 in which the first housing has at least one light source electrically coupled to said power source.

18. A special effect cartridge having a first housing defining a sealed chamber having a translucent portion for transmitting light;

a second housing coupled to the first housing and defining an open acoustic chamber having at least one opening for transmitting sound;

an electronic circuit received in said sealed chamber including a power source operatively coupled to at least one light source and at least one movement actuated electrical switch received in said sealed chamber for energizing said light source and a loudspeaker; and a loudspeaker disposed in said second housing for emitting sound through said open acoustic chamber, wherein movement of the special effect cartridge will trigger sound and light to be transmitted.

19. A special effect cartridge having a first housing defining a sealed chamber;

a second housing coupled to the first housing and defining an open acoustic chamber having at least one opening for transmitting sound;

a loudspeaker disposed in said second housing for emitting sound through said open acoustic chamber;

an electronic circuit received in said sealed chamber including a power source;

an external switch electrically coupled to said electronic circuit, the external switch being actuated by contact with a conductive medium for energizing said loudspeaker, wherein wetting of the special effect cartridge with a conductive medium will trigger sound to be transmitted from the special effect cartridge.

20. A soap bar having a soap body defining a cavity and a special effect cartridge received in said cavity, the special effect cartridge having a first housing defining a sealed chamber having a translucent portion for transmitting light;

a second housing coupled to the first housing and defining an open acoustic chamber, the second housing having a plurality of openings for transmitting sound, at least one opening being formed in a surface adjacent to said translucent portion on one side of the special effect cartridge and at least one opening being formed in an opposite surface;

an electronic circuit received in said sealed chamber including a power source operatively coupled to at least one light source and at least one movement actuated electrical switch received in said sealed chamber for energizing said light source and a loudspeaker; and a loudspeaker disposed in said second housing for emitting sound through said open acoustic chamber, wherein movement of the soap bar will trigger sound and light to be transmitted from the special effect cartridge.

21. A soap bar having a soap body defining a cavity and a special effect cartridge received in said cavity, the special effect cartridge having a first housing defining a sealed chamber;

a second housing coupled to the first housing and defining an open acoustic chamber, the second housing having a plurality of openings for transmitting sound, at least one opening being formed in a surface on one side of the special effect cartridge and at least one opening being formed in an opposite surface, thereby allowing any conductive medium to drain through the special effect cartridge;

a loudspeaker disposed in said second housing for emitting sound through said open acoustic chamber, an electronic circuit received in said sealed chamber including a power source;

an external switch electrically coupled to said electronic circuit, the external switch being actuated by contact with a conductive medium for energizing said loudspeaker, wherein wetting of the soap bar with a conductive medium will trigger sound to be transmitted from the special effect cartridge.

22. A soap bar having a soap body defining a cavity and a special effect cartridge received in said cavity, the special effect cartridge having a first housing defining a sealed chamber;

a second housing coupled to the first housing and defining an open acoustic chamber, the second housing having a plurality of openings for transmitting sound, at least one opening being formed in a surface on one side of the special effect cartridge and at least one opening being formed in an opposite surface;

an electronic circuit received in said sealed chamber including a power source operatively coupled to at least one movement actuated electrical switch received in said sealed chamber for energizing a loudspeaker; and a loudspeaker disposed in said second housing for emitting sound through said open acoustic chamber, wherein movement of the soap bar will trigger sound to be transmitted from the special effect cartridge.

23. A soap bar having a soap body defining a cavity and a special effect cartridge received in said cavity, the special effect cartridge having a first housing defining a sealed chamber;

a second housing coupled to the first housing and defining an open acoustic chamber having at least one opening for transmitting sound;

a loudspeaker disposed in said second housing for emitting sound through said open acoustic chamber, an electronic circuit received in said sealed chamber including a power source;

an external switch electrically coupled to said electronic circuit, the external switch being actuated by contact with a conductive medium for energizing said loudspeaker, wherein wetting of the soap bar with a conductive medium will trigger sound to be transmitted from the special effect cartridge.

24. A soap bar according to claim 23 in which the electronic circuit includes a programmable integrated circuit for performing a predetermined sequence of sound effects.

25. A soap bar according to claim 23 in which the first housing has at least one light source electrically coupled to said power source.

26. A soap bar according to claim 23 in which the external switch comprises a pair of spaced-apart electric probes.

27. A soap bar according to claim 23 in which the second housing has an inlet opening disposed adjacent to said external switch for allowing a conductive medium to come into contact with said external switch.

28. A special effect cartridge having a first housing defining a sealed chamber;

a second housing coupled to the first housing and defining an open acoustic chamber, the second housing having a plurality of openings for transmitting sound, at least one opening being formed in a surface on one side of the special effect cartridge and at least one opening being formed in an opposite surface, thereby allowing any conductive medium to drain through the special effect cartridge;

a loudspeaker disposed in said second housing for emitting sound through said open acoustic chamber;

an electronic circuit received in said sealed chamber including a power source;

an external switch electrically coupled to said electronic circuit, the external switch being actuated by contact with a conductive medium for energizing said loudspeaker, wherein wetting of the special effect cartridge with a conductive medium will trigger sound to be transmitted from the special effect cartridge.

29. A soap bar according to claim 23 in which the soap body has a cavity which extends through opposite surfaces of the soap body.

30. A special effect cartridge having a first housing defining a sealed chamber having a translucent portion for transmitting light;

a second housing coupled to the first housing and defining an open acoustic chamber, the second housing having a plurality of openings for transmitting sound, at least one opening being formed in a surface adjacent to said translucent portion on one side of the special effect cartridge and at least one opening being formed in an opposite surface;

an electronic circuit received in said sealed chamber including a power source operatively coupled to at least one light source and at least one movement actuated electrical switch received in said sealed chamber for energizing said light source and a loudspeaker; and a loudspeaker disposed in said second housing for emitting sound through said open acoustic chamber, wherein movement of the special effect cartridge will trigger sound and light to be transmitted.

31. A special effect cartridge having a first housing defining a sealed chamber;

a second housing coupled to the first housing and defining an open acoustic chamber having at least one opening for transmitting sound;

an electronic circuit received in said sealed chamber including a power source operatively coupled to at least one movement actuated electrical switch received in said sealed chamber for energizing a loudspeaker; and a loudspeaker disposed in said second housing for emitting sound through said open acoustic chamber, wherein movement of the soap bar will trigger sound to be transmitted from the special effect cartridge.

* * * * *